US006554127B1

(12) United States Patent
Kroll

(10) Patent No.: US 6,554,127 B1
(45) Date of Patent: Apr. 29, 2003

(54) POWER AND FREE CONVEYOR

(75) Inventor: Michael Kroll, Nagold (DE)

(73) Assignee: Eisenmann Maschinenbau KG (DE)

( * ) Notice: Subject to any disclaimer, the term of this patent is extended or adjusted under 35 U.S.C. 154(b) by 0 days.

(21) Appl. No.: 10/018,393

(22) PCT Filed: May 31, 2000

(86) PCT No.: PCT/EP00/04956

§ 371 (c)(1),
(2), (4) Date: Dec. 7, 2001

(87) PCT Pub. No.: WO00/74992

PCT Pub. Date: Dec. 14, 2000

(30) Foreign Application Priority Data

Jun. 7, 1999 (DE) ..... 199 25 836

(51) Int. Cl.[7] ..... B65G 29/00
(52) U.S. Cl. ..... 198/465.4; 104/172.4
(58) Field of Search ..... 198/465.4; 104/172.4, 104/172.2

(56) References Cited

U.S. PATENT DOCUMENTS

| | | | | | |
|---|---|---|---|---|---|
| 3,451,352 | A | | 6/1969 | Curry et al. | 104/172 |
| 3,618,532 | A | * | 11/1971 | Clewett et al. | 104/172.4 |
| 3,662,873 | A | * | 5/1972 | Ross | 104/172.4 |
| 3,726,233 | A | * | 4/1973 | Swartz | 104/172.4 |
| 3,793,965 | A | * | 2/1974 | Winters | 104/172.4 |
| 3,800,710 | A | * | 4/1974 | Raoulx | 104/251 |
| 3,812,787 | A | * | 5/1974 | Kling | 104/96 |
| 3,818,840 | A | * | 6/1974 | Dehne | 104/172.4 |
| 3,906,867 | A | * | 9/1975 | Knudsen | 104/172.4 |
| 3,915,287 | A | * | 10/1975 | Seymour et al. | 198/367 |
| 3,948,186 | A | * | 4/1976 | McCaul | 104/172.4 |
| 3,995,561 | A | * | 12/1976 | Allor, Jr. | 104/172.4 |
| 4,031,829 | A | * | 6/1977 | Bell et al. | 104/172.4 |
| 4,143,599 | A | * | 3/1979 | Krammer | 104/172.4 |
| 4,148,261 | A | * | 4/1979 | Wakabayashi | 104/172.4 |
| 4,223,610 | A | | 9/1980 | Lempio | 104/172 |
| 4,389,944 | A | | 6/1983 | Linton et al. | 104/172 |
| 4,461,216 | A | * | 7/1984 | Carney | 104/172.3 |
| 5,606,915 | A | * | 3/1997 | Harris | 104/172.4 |
| 5,664,501 | A | * | 9/1997 | Harris | 104/172.4 |
| 5,690,032 | A | * | 11/1997 | Koga et al. | 104/172.1 |
| 5,842,421 | A | * | 12/1998 | Desilets et al. | 104/172.4 |
| 5,852,979 | A | * | 12/1998 | Desilets et al. | 104/172.4 |
| 6,308,637 | B1 | * | 10/2001 | Sheets et al. | 104/172.4 |
| 6,367,612 | B1 | * | 4/2002 | Dosso et al. | 198/465.4 |
| 6,374,747 | B1 | * | 4/2002 | Devnani et al. | 104/162 |

FOREIGN PATENT DOCUMENTS

| | | |
|---|---|---|
| DE | 1 268 064 | 5/1968 |
| DE | 25 23 060 | 12/1976 |
| DE | 3 204 729 | 8/1983 |

* cited by examiner

*Primary Examiner*—Christopher P. Ellis
*Assistant Examiner*—Richard Ridley
(74) *Attorney, Agent, or Firm*—Factor & Partners

(57) ABSTRACT

The invention relates to a power & free conveyor which comprises a free rail (3) and a power chain (1) that follows said free rail (3), to a large extent, in a parallel manner. A transport carriage (4) provided with a front runner (5) and a rear runner (6) are arranged on the free rail (3). The front runner (5) and the rear runner (6) each comprise a carrier (11, 14) that can pivot between two positions. In an area of the movement path of the transport carriage (4), the course of the power chain (1) deviates from that of the free rail (3) so that the transport carriages (4) can no longer be moved via the front runner carrier (1) thereof. Instead, the transport carriage is pushed by the interaction between a chain carrier (2) and the rear runner carrier (14) that is swung out into a carrying position. The rear runner carrier (14) comprises two stabile positions which can be changed by overcoming a resistance. To this end switch-over devices (24, 22) are provided which are arranged at the necessary locations along the movement path of the transport carriages (4).

4 Claims, 4 Drawing Sheets

POWER AND FREE CONVEYOR

Figure 1:
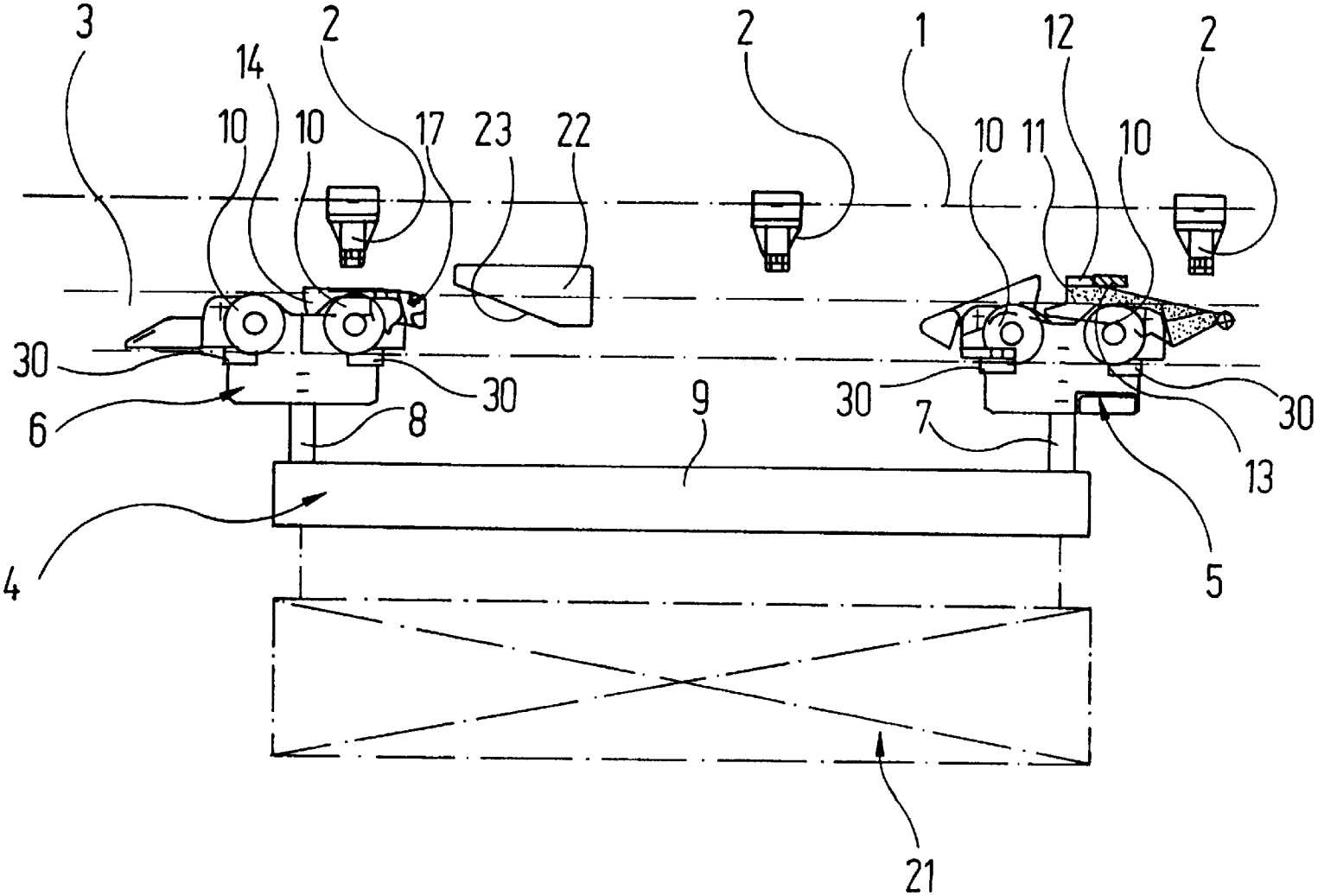

The invention relates to a power & free conveyor comprising a) at least one free rail;

b) at least one transport carriage, which comprises an, in direction of motion, leading front runner and an, in direction of motion, trailing rear runner, each of which is guided by the free rail, wherein front runner and rear runner each have a pusher dog, which may adopt a higher driving position and a lower position of rest;

c) at least one power rail, in which a power chain is guided, which carries a plurality of chain pusher dogs, which cooperate with the pusher dogs of the transport carriage in their driving position, d) in at least one region of the path of motion of the a transport carriage the power chain deviates from the course of the free rail in such a way that the chain pusher dogs are no longer in engagement with the front runner pusher dog and in said region the transport carriage are moved through interaction between the chain pusher dogs and the rear runner pusher dog.

Power & free conveyors are two-rail systems. In the upper power rail a power chain with pusher dogs runs continuously. Running in the lower rail, the load or free rail, are the transport carriages, to which the load to be conveyed is attached. For specific processing operations of the loads attached to the transport carriages it is necessary to lower said loads in a special lifting station, which is introduced into the course of the free rail, and then lift them again. In the region of said lifting station it is impossible for the power chain to be conveyed parallel to the free rail situated below because space is needed for the cables, chains or belts, with the aid of which the load is moved vertically. For said reason, in said region the power chain swings out sideways before resuming its parallel course to the free rail in the end region of the lifting station. In the region where the power chain no longer extends above the free rail an interaction between the chain pusher dogs and the front runner pusher dogs of the transport carriages may no longer occur, thereby ruling out the front runner pusher dogs for moving the transport carriages. This is where the rear runner pusher dogs come in, which are still situated in a region, in which the power chain lies sufficiently precisely above the free rail. Through interaction between the chain pusher dogs and the rear runner pusher dogs of the transport carriages the latter are pushed so far into the lifting station that the front runner pusher dog may in principle already be grasped again by the chain pusher dogs.

Like the pusher dog of the front runner, the pusher dog of the rear runner also has to be capable of adopting two different positions, namely a position of rest, which lies below the path of motion of the chain pusher dogs, and a driving position, in which it projects into the path of motion of the chain pusher dogs. In known, commercially available power & free conveyors of the type described initially, the rear runner pusher dog is supported pivotally about a horizontal axis, wherein a suitable centre-of-gravity position ensures that the rear runner pusher dog has a tendency to rotate into the driving position. This is prevented in all locations, where the rear runner pusher dog is to adopt its position of rest, by the fact that the rear runner pusher dog lies with its uppermost point against a suitable guide surface of the free rail and slides along said guide surface. It is only in locations, where the rear runner pusher dog is to switch over into the driving position, that the guide surface of the free rail has cutouts so that the rear runner pusher dog may tilt further into the driving position.

Said known construction has several drawbacks: firstly, the guide surface of the free rail and the rear runner pusher dog are subject to extreme wear as a result of the constant sliding contact. Secondly, however, the positions, at which the switchover of the rear runner pusher dog into the driving position is to occur, are not variable but permanently defined by the cutouts in the free rail.

The object of the present invention is to construct a power & free conveyor of the type described initially in such a way that as little wear as possible occurs at the rear runner pusher dog and that the positions along the path of motion of the transport carriages, at which the switchover of the rear runner pusher dog is effected, are variably selectable.

Said object is achieved according to the invention in that e) the two positions of the rear runner pusher dog are stable positions in the sense that for a change between the two positions a resistance has to be overcome;

f) switchover devices are provided along the path of motion of the transport carriage at the locations where a change of the positions of the rear runner pusher dog is to occur and, to said end, exert on the rear runner pusher dog a force, which overcomes the resistance.

The power & free conveyor according to the invention therefore renounces the old concept, according to which the rear runner pusher dog is constantly loaded in the direction of its driving position and movement into the driving position is prevented by sliding contact with the free rail at the appropriate locations. Instead, the rear runner pusher dog according to the invention is mounted in a "bistable" manner: it maintains each of its two operating positions permanently so long as the resistance between the two positions is not overcome through application of an external force. This means in particular that in the position of rest the rear runner pusher dog does not lie slidingly against any other part, with the result that wear is prevented. The switchover devices, by means of which the force needed to overcome the resistance between the positions of the rear runner pusher dog is applied, may be mounted on at any desired positions of the free rail. Subsequent adjustment is also easily possible. Thus, the power & free conveyor according to the invention is very much more variable than that according to prior art.

On the rear runner pusher dog a lug is preferably formed, which cooperates with a spring fastened to the rear runner. Upon pivoting of the rear runner the lug presses upon the spring, which between the two positions of the rear runner pusher dog experiences a maximum deformation but in the two stable positions of the rear runner pusher dog, on the other hand, relaxes or is only deformed relatively slightly.

When the spring comprises an offset end region, the point, at which the resistance between the two positions of the rear runner pusher dog is to be overcome, may be marked precisely.

The switchover device, which presses the rear runner pusher dog out of its driving position into the position of rest, is preferably a stop strip, which in a second function is intended for interaction with the front runner pusher dog.

Such stop strips are already known from prior art. They may be moved from a position outside of the path of motion of the front runner pusher dog into a position within said path of motion, in which position they press the front runner pusher dog of the approaching transport carriage down and hence bring it out of engagement with the chain pusher dogs of the power chain. By virtue of the fact that in the present embodiment of the invention said stop strip is assigned a second function during the actuation of the rear runner pusher dog, the number of necessary components may be kept low.

The switchover device, which presses the rear runner pusher dog out of the position of rest into the driving position, may be a crank part. By virtue of appropriate surfaces and/or parts of said crank part and of the rear runner pusher dog sliding past one another the rear runner pusher dog is brought into the driving position, there being no need for further control elements for said purpose.

To reduce the expenditure of force associated with the switchover of the rear runner pusher dog into the driving position, the crank part may cooperate with a roller provided on the rear runner pusher dog.

Figure 2:
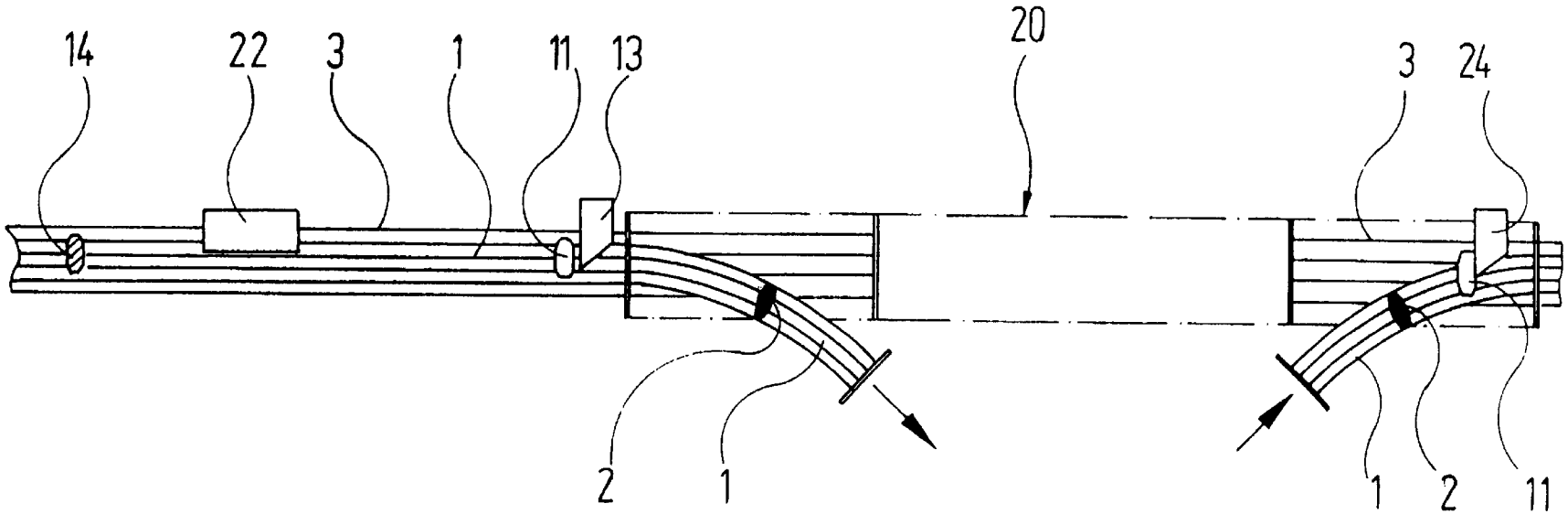
Figure 3:
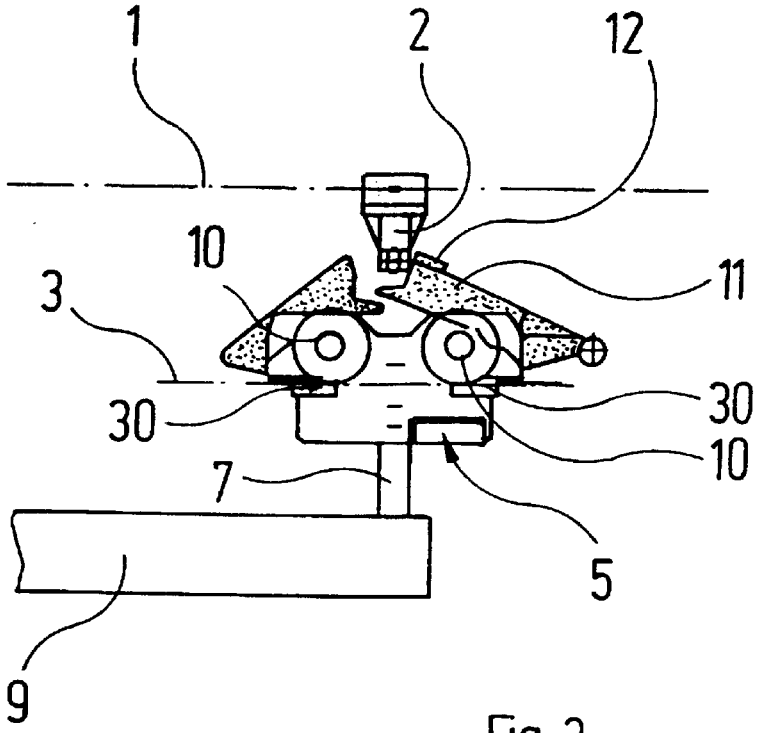
Figure 4:
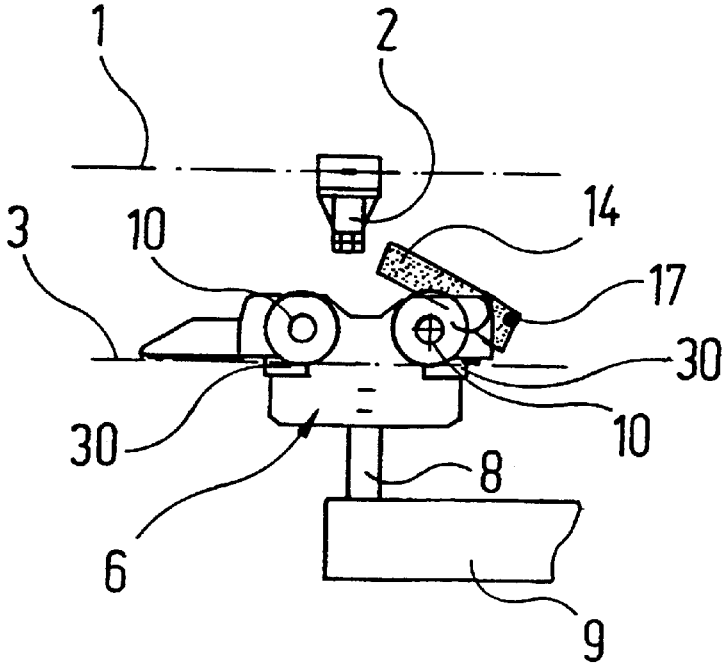
Figure 5:
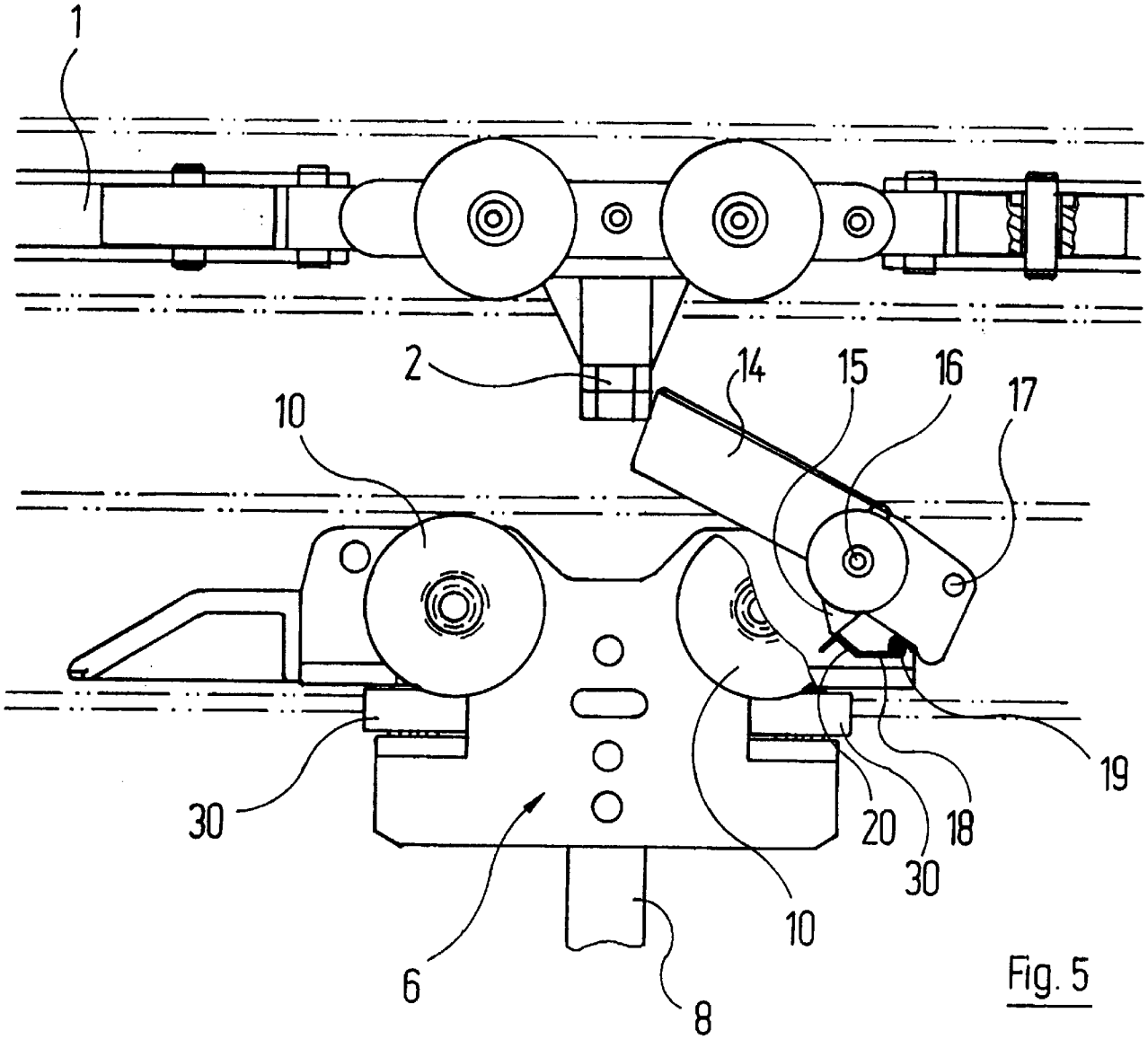

There now follows a detailed description of an embodiment of the invention with reference to the drawings; said drawings show:

FIG. 1 a detail from the side view of a power & free conveyor with a transport carriage;

FIG. 2 the plan view of a detail of a power & free conveyor in the region of a lifting station;

FIG. 3 the front runner of the transport carriage of FIG. 1 with an activated front runner pusher dog;

FIG. 4 the rear runner of the transport carriage of FIG. 1 with an activated rear runner pusher dog;

FIG. 5 to an enlarged scale and in greater detail the rear runner of the transport carriage of FIG. 1 in engagement with a pusher dog of the power chain.

In FIG. 1 a detail of a power & free conveyor is diagrammatically illustrated. It comprises a power chain 1, on which downward projecting chain pusher dogs 2 are situated at regular intervals. The power chain 1 is indicated only diagrammatically by a dash-dot line.

Extending below and substantially parallel to the power chain 1 is a free rail 3, along which a plurality of transport carriages 4 are conveyed in a suspended manner. The free rail 3 is likewise indicated only diagrammatically by dash-dot lines.

One of the transport carriages 4 is illustrated in FIG. 1. It comprises a front runner 5 and a rear runner 6, from which a spreader 9 is suspended via struts 7, 8. In a known manner, front runner 5 and rear runner 6 each have running gear comprising four support rollers 10; the support rollers 10 with horizontal axes engage into corresponding profiles of the free rail 3. Situated on the front runner 5 and on the rear runner 6 there are in each case two guide rollers 30, which each have a vertical axis and run along vertical lateral guide surfaces of the free rail 3.

The front runner 5 has a pivoted front runner pusher dog 11 with a driving block 12, which is capable of adopting two different positions. FIG. 1 shows the pivoted position of the front runner pusher dog 11, in which the driving block 12 is situated below the path of motion of the chain pusher dogs 2; the transport carriage 4 is therefore not grasped by the power chain 1 and remains stationary. Said position of rest of the front runner pusher dog 11 is brought about by a stop strip 13, which is fastened to the free rail 3 so as to be movable in such a way that it may be inserted into, and also pulled back out of, the path of motion of the front runner pusher dog 11. When the stop strip 13 is situated in the path of motion of the front runner pusher dog 12, the former presses the latter down into the position of rest shown in FIG. 1.

When, on the other hand, the stop strip 13 is pulled laterally out of the path of motion of the front runner pusher dog 11, the latter tilts under the influence of the force of gravity into its second position, the driving position shown in FIG. 3. In said position the driving block 12 of the front runner pusher dog 11 lies in the path of motion of the chain pusher dogs 2 with the result that, when a chain pusher dog 2 runs past, the transport carriage 4 is grasped and moved forward.

The rear runner 6 of the transport carriage 4 shown in FIG. 1 also has a pusher dog 14, which is capable of adopting two different positions: in the position of rest illustrated in FIG. 1 the rear runner pusher dog 14 is likewise situated below the path of motion of the chain pusher dogs 2. In a manner, which will be described in detail further below, it may be switched over into a second position, the driving position which is shown in FIG. 4. In said second position the rear runner pusher dog 14 is pivoted in such a way that it lies with its upper region in the path of motion of the chain pusher dogs 2. When a chain pusher dog 2 comes past, it acts upon the outwardly pivoted rear runner pusher dog 14 and "pushes" the transport carriage 4 in front of it.

It is evident from the above description that for the transport carriage 4 the following movement options exist. When the front runner pusher dog 11 is set into the position shown in FIG. 3, the transport carriage 4 is "pulled" via the front runner pusher dog 11. The rear runner pusher dog 14 is situated, in said case, in the position of rest shown in FIG. 1. Alternatively, the rear runner pusher dog 14 may be pivoted into the driving position shown in FIG. 4; the transport carriage 4 is then "pushed" by the chain pusher dogs 2. The front runner pusher dog 11, in said case, need not necessarily be in the position of rest, as will be explained below.

Finally, when both pusher dogs 11, 14 are pivoted into the position of rest shown in FIG. 1, the transport carriage 4 remains stationary.

The exact style of construction of the rear runner pusher dog 14 and its connection to the rear runner 6 are evident from FIG. 5. It is a straight, approximately rectangular part, on the underside of which an offset lug 15 is formed. The pusher dog 14 is coupled between its ends by means of a pivot pin 16 to the rear runner 6. The rear runner pusher dog 14 in the vicinity of its, in direction of motion, leading end carries a roller 17, which in a manner yet to be described is used to switch the rear runner pusher dog 14 into one of its two positions.

An end of a spring 18 is fastened by a pin or bolt 19 to the rear runner 6. The freely projecting end 20 of the spring 18 is formed in an offset manner, wherein the tip of the region 20 is directed towards the tip of the lug 15 of the rear runner pusher dog 14. The mutual geometrical arrangement and construction is such that the lug 15, when the rear runner pusher dog 14 moves from the driving position shown in FIGS. 4 and 5 into the position of rest shown in FIG. 1, inevitably presses the offset region 20 of the spring 18 in a downward direction; the same applies to the return of the rear runner pusher dog 14 from the position of rest shown in FIG. 1 into the driving position shown in Figures 4 and 5.

The rear runner pusher dog 14 by virtue of its lug 15, which cooperates with the offset region 20 of the spring 18, therefore has two stable positions, which may not be left without the action of external forces.

The significance of the previously described style of construction of the rear runner pusher dog 14 is explained with reference to FIG. 2: the latter shows, in plan view, a detail of a power & free conveyor. The conveying direction of the transport carriage in FIG. 2 is from left to right. In the highly schematized drawing the free rail 3 (which is wider) situated further below and the power rail situated above with the power chain 1 may be seen. The chain pusher dogs 2 are drawn in a filled-in manner in FIG. 2; front runner pusher dogs 11 are shown by an empty contour and rear runner pusher dogs 14 with hatching.

FIG. 2 shows a situation, in which a lifting station 20 is situated in the path of motion of the transport carriages 4.

The lifting station 20 is indicated diagrammatically by a dash-dot border. In said lifting station 20 the loads 21 conveyed by the transport carriages 4 have to be lowered for treatment, e.g. immersion in a bath, and, after treatment has been completed, lifted again and conveyed onwards. So that the cables, chains or belts needed to lower the load 21 may be conveyed upwards, in the region of the lifting station 20 the power chain 1 may not be conveyed parallel above the free rail 3. Rather, on reaching the lifting station 20 the power chain bends laterally outwards via a curve, is conveyed in an arc not shown in detail in the drawings and finally returns via a further curve to a position over the free rail 3 in the end region of the lifting station 20. In the region of the path of motion of the transport carriages 4 where the chain pusher dogs 2, because of the outwardly bent free rail 1, may no longer be in engagement with the front runner pusher dogs 11 of the transport carriages 4, the respective rear runner pusher dog 14 takes over the task of advancing the transport carriages 4 in the following manner.

The left region of FIG. 2 in front of the entry into the lifting station 20 may be interpreted as a queueing or allocating position. This is precisely the portion which is also illustrated in FIG. 1. Situated at the end of the queueing portion is the stop strip 13, which by running onto the front runner pusher dog 11 has pressed the latter down into the position of rest so that the transport carriage 4, the two pusher dogs 11, 14 of which are diagrammatically indicated in FIG. 2, remains stationary before entering the lifting station 20. When the lifting station 20 is ready to receive a transport carriage, i.e. is in particular unoccupied and in the correct vertical position, the stop strip 13 is pulled away to the side. The front runner pusher dog 11 of the transport carriage 4 by virtue of its weight then tilts into the driving position shown in FIG. 3; the transport carriage 4 is pulled into the lifting station 20 in the usual manner with the aid of the chain pusher dogs 2.

Mounted on the free rail 3 at a specific distance in front of the stop strip 13 is a crank part 22, which has a crank surface 23 (cf. FIG. 1) inclined counter to the direction of motion of the transport carriages 4. The crank surface 23 of the crank part 22 is disposed in such a way that it cooperates with the rollers 17 provided on the rear runner pusher dogs 14. This occurs in that the crank surface 23, as the transport carriage 4 travels past, presses the roller 17 of the rear runner pusher dog 14 downwards so that the rear runner pusher dog 14—while simultaneously overcoming the elastic force of the spring 18—moves into the driving position shown in FIGS. 4 and 5. Shortly after this has occurred, the power chain 1 moves laterally outwards, with the result that the front runner pusher dog 11 may no longer participate in the forward conveying of the transport carriage 4. However, when a further chain pusher dog 2 then approaches the transport carriage 4 from the rear, it moves in the manner shown in FIG. 5 into abutment with the rear runner pusher dog 14 situated in the driving position and then pushes the transport carriage 4 further forward into the lifting station 20 until the transport carriage 4 has finally reached the position, in which it may be lowered. Said position is defined by a further stop strip 24, which already lies in a region of the free rail 3 where the chain pusher dogs 2 have already moved far enough back into the path of motion of the front runner pusher dogs 11 to allow the transport carriages 4 to be moved on through interaction between the chain pusher dogs 2 and the front runner pusher dogs 11. The load on the transport carriage 4 is then lowered and, after treatment has been completed, lifted again with the aid of non-illustrated cables, chains or belts.

As a result of the stop strip 24 being briefly pulled away, the front runner pusher dog 11 of the transport carriage 4 situated in the lifting station 20 moves into its driving position; the next chain pusher dog 2 coming past then moves the transport carriage 4 further. Immediately after the front runner pusher dog 11 has passed through, the stop strip 24 is re-inserted into the path of motion of the pusher dogs 11, 14 of the transport carriage 4. When the rear runner pusher dog 14 then passes the stop strip 24, the stop strip 24 encounters the inclined upper side of the rear runner pusher dog 14 and, as the transport carriage 4 moves forward, pivots the rear runner pusher dog 14 back into its position of rest, which is shown in FIG. 1, while simultaneously overcoming the force of the spring 18. The transport carriage 4 then moves on in the usual manner.

What is claimed is:

1. Power and free conveyor comprising:

a) at least one free rail;

b) at least one transport carriage, which comprises, in a direction of motion, a leading front runner and, in the direction of motion, a trailing rear runner, each of which is guided by the free rail, wherein the leading front runner and the trailing rear runner each have a pusher dog, which may adopt a stable higher driving position and a stable lower position of rest;

c) at least one power rail, in which a power chain is guided, which carries a plurality of chain pusher dogs, which cooperate with the pusher dogs of the transport carriage in their driving position, in which d) in at least one region of the path of motion of the transport carriages the power chain deviates from the course of the free rail in such a way that the chain pusher dogs are no longer in engagement with the front runner pusher dog and in said region the transport carriage is moved through interaction between the chain pusher dogs and the rear runner pusher dog;

e) switchover devices are provided along the path of motion of the transport carriages at the locations, at which a change of the positions of the rear runner pusher dog is to occur, wherein f) the two positions of the rear runner pusher dog are stable positions in the sense that for a change between the two positions a resistance has to be overcome, for which purpose on the rear runner pusher dog a lug is formed, which cooperates with a spring, which comprises an offset end region and is fastened to the rear runner.

2. Power and free conveyor as claimed in claim 1, wherein the switchover device, which presses the rear runner pusher dog out of its driving position into the position of rest, is a stop strip, which in a second function is intended for interaction with the front runner pusher dog.

3. Power and free conveyor as claimed in claim 1, wherein the switchover device, which presses the rear runner pusher dog out of the position of rest into the driving position, is a crank part.

4. Power and free conveyor as claimed in claim 3, wherein the crank part cooperates with a roller provided on the rear runner pusher dog.

* * * * *